US010385430B2

(12) United States Patent
Oura et al.

(10) Patent No.: US 10,385,430 B2
(45) Date of Patent: Aug. 20, 2019

(54) HIGH-STRENGTH STEEL MATERIAL HAVING EXCELLENT FATIGUE PROPERTIES

(71) Applicant: KOBE STEEL, LTD., Kobe-shi (JP)

(72) Inventors: Hiroshi Oura, Kobe (JP); Tomokazu Masuda, Kobe (JP); Nao Yoshihara, Kobe (JP); Takayuki Naito, Kobe (JP); Akito Suzuki, Kobe (JP)

(73) Assignee: KOBE STEEL, LTD., Kobe-shi (JP)

( * ) Notice: Subject to any disclaimer, the term of this patent is extended or adjusted under 35 U.S.C. 154(b) by 489 days.

(21) Appl. No.: 15/128,661

(22) PCT Filed: Mar. 27, 2015

(86) PCT No.: PCT/JP2015/059675
§ 371 (c)(1),
(2) Date: Sep. 23, 2016

(87) PCT Pub. No.: WO2015/152063
PCT Pub. Date: Oct. 8, 2015

(65) Prior Publication Data

US 2018/0216214 A1 Aug. 2, 2018

(30) Foreign Application Priority Data

Mar. 31, 2014 (JP) ..... 2014-073605

(51) Int. Cl.

| | |
|---|---|
| ***C22C 38/00*** | (2006.01) |
| ***C22C 38/54*** | (2006.01) |
| ***C21D 8/06*** | (2006.01) |
| ***C22C 38/34*** | (2006.01) |
| ***C21D 1/25*** | (2006.01) |
| ***C22C 38/04*** | (2006.01) |
| ***C22C 38/06*** | (2006.01) |
| ***C22C 38/24*** | (2006.01) |
| ***C22C 38/32*** | (2006.01) |
| ***C22C 38/46*** | (2006.01) |
| ***C21D 9/52*** | (2006.01) |
| ***C22C 38/02*** | (2006.01) |

(52) U.S. Cl.
CPC ..... *C22C 38/54* (2013.01); *C21D 1/25* (2013.01); *C21D 8/06* (2013.01); *C21D 8/065* (2013.01); *C21D 9/525* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/24* (2013.01); *C22C 38/32* (2013.01); *C22C 38/34* (2013.01); *C22C 38/46* (2013.01); *C21D 9/52* (2013.01); *C21D 2211/008* (2013.01)

(58) Field of Classification Search
CPC .... C22C 38/00; C22C 38/02; C21D 2211/008
See application file for complete search history.

(56) References Cited

U.S. PATENT DOCUMENTS

| | | | |
|---|---|---|---|
| 6,527,883 | B1 | 3/2003 | Kawabe et al. |
| 2003/0168136 | A1 | 9/2003 | Kawabe et al. |
| 2006/0156864 | A1 | 7/2006 | Sakamoto et al. |
| 2008/0202289 | A1 | 8/2008 | Sakamoto et al. |
| 2008/0271824 | A1 | 11/2008 | Fujino et al. |
| 2010/0224287 | A1 | 9/2010 | Kochi et al. |

FOREIGN PATENT DOCUMENTS

| | | | |
|---|---|---|---|
| EP | 2832891 | A1 | 2/2015 |
| JP | 1-184223 | A | 7/1989 |
| JP | 11-71638 | A | 3/1999 |
| JP | 2001-181794 | A | 7/2001 |
| JP | 2007-191776 | A | 8/2007 |
| JP | 2007-270293 | A | 10/2007 |
| JP | 4357977 | B2 | 11/2009 |
| JP | 4417792 | B2 | 2/2010 |
| JP | 2013-213238 | A | 10/2013 |

OTHER PUBLICATIONS

International Search Report dated May 19, 2015 in PCT/JP2015/059675 filed Mar. 27, 2015.
English translation of the International Preliminary Report on Patentability and Written Opinion dated Oct. 4, 2016 in PCT/JP2015/059675.

*Primary Examiner* — Jie Yang
*Assistant Examiner* — Jophy S. Koshy
(74) *Attorney, Agent, or Firm* — Oblon, McClelland, Maier & Neustadt, L.L.P.

(57) ABSTRACT

The present invention provides a steel material, such as a high-strength spring, that has excellent fatigue properties, and, more specifically, a steel material, such as the high-strength spring, that can improve the fatigue properties in a high-strength region more easily, without increasing an alloy cost. The steel material includes, in percent by mass, C: 0.5 to 1.0%, Si: 1.5 to 2.50%, Mn: 0.5 to 1.50%, P: more than 0% to 0.020% or less, S: more than 0% to 0.020% or less, Cr: more than 0% to 0.2% or less, Al: more than 0% to 0.010% or less, N: more than 0% to 0.0070% or less, and O: more than 0% to 0.0040% or less, and the balance consisting of iron and inevitable impurities, wherein Cr and Si contents satisfy a formula of $Cr \times Si \leq 0.20$, a ratio of tempered martensite in a steel microstructure is 80% or more by area, and a number density of particles of Cr-containing carbide or carbonitride having a circle-equivalent diameter of 50 nm or more in the steel microstructure is 0.10 particles/$\mu m^2$ or less.

2 Claims, 5 Drawing Sheets

HIGH-STRENGTH STEEL MATERIAL HAVING EXCELLENT FATIGUE PROPERTIES

TECHNICAL FIELD

The present invention relates to a high-strength steel material with excellent fatigue properties, particularly, spring fatigue properties. These high-strength steel materials include a steel wire for a spring produced by quenching and tempering a drawn wire rod; a spring produced by spring-coiling the steel wire for a spring; and a spring produced by spring-coiling a drawn wire rod and then quenching and tempering.

BACKGROUND ART

With the tendency to decrease the weight of and apply a high stress to automobiles and the like, valve springs, clutch springs and the like that are used in engines, clutches and the like have been designed so as to apply higher stress. Therefore, the applied stress to the springs is increased, which requires those springs to have excellent fatigue properties and setting resistance, in particular, to have excellent fatigue properties due to being less likely to cause fatigue failure because of their internal defects.

In recent years, most of valve springs, clutch springs and the like have been manufactured by quenching and tempering, called oil tempering, a drawn wire rod to forma steel wire with a tempered martensite microstructure, and then spring-coiling the obtained steel wire at an ordinary temperature (cold working). Some of springs are produced by spring-coiling a drawn wire rod at an ordinary temperature, and then quenching and tempering the obtained spring-coiled wire. In either manufacturing method, the microstructure of the steel material of the spring is tempered martensite.

The above-mentioned tempered martensite is convenient to achieve high strength, and advantageously capable of enhancing the fatigue strength and setting resistance. However, the toughness and ductility of the steel material are reduced with increasing strength, which might easily cause a breakage due to internal defects in the steel material such as inclusions and the like. This could result in degradation of the fatigue properties.

The following have been proposed against the degradation in the fatigue properties by increasing strength due to the tempered martensite microstructure. For example, Patent Document 1 disclose a technique as follows: when Li is included in a total amount of Li of 0.020 ppm to 20 ppm in terms of mass, "Li is trapped in a complex oxide during manufacturing the steel to form a single-phase complex oxide (for example, $CaO—Al_2O_3—SiO_2—MnO—MgO—Li_2O$ based complex oxide and the like). When heating this steel, material to a hot working temperature, the Li-containing complex oxide based inclusions are progressively separated into a glassy phase and a crystalline phase. The crystalline phases are finely precipitated as the equilibrium phase in the glassy single-phase inclusions. When blooming and hot-rolling the steel material in this state, a glassy portion demonstrates the excellent drawability because of its low melting point and low viscosity. Meanwhile, stress is concentrated on an interface between the crystalline phase and glassy phase during rolling, whereby dividing with remarkable ease, making the inclusions much finer". Consequently, patent document 1 explains that the fatigue properties can be improved. However, this technique is not easy because control is needed during a steel manufacturing process in order to obtain a single-phase complex oxide. Furthermore, the technique is susceptible to external factors, including a heating condition, heat treatment temperature and the like during manufacturing.

Patent Document 2 discloses a steel wire for a spring obtained by patenting and drawing a steel material, followed by quenching and tempering. The patenting treatment involves heating the steel material at 900 to 1050° C. for 60 to 180 seconds for austenitizing, and then heating at 600 to 750° C. for 20 to 100 seconds under an isothermal transformation condition. The steel wire for a spring has a tempered martensite microstructure, and contains, in percent by mass, C: 0.50 to 0.75%, Si: 1.80 to 2.70%, Mn: 0.1 to 0.7%, Cr: 0.70 to 1.50%, and Co: 0.02 to 1.00%, and the balance consisting of Fe and inevitable impurities. The steel wire has a reduction of area after the quenching and tempering of 40% or more. In addition, the steel wire has a shear yield stress of 1,000 MPa or more after heat treatment at a temperature of 420° C. or higher and 480° C. or lower for 2 or more hours and then the quenching and tempering. That is, the technique specifies the patenting heat treatment, the reduction of area after the quenching and tempering, and the shear yield stress after a heat treatment which is equivalent to a nitriding treatment, thereby ensuring the fatigue properties and high toughness. However, the above-mentioned steel wire essentially includes Co and includes large amount of Cr, leading to high cost of the alloy.

PRIOR ART DOCUMENT

Patent Document

Patent Document 1: JP 4417792 B1
Patent Document 2: JP 4357977 B1

DISCLOSURE OF THE INVENTION

Problems to be Solved by the Invention

The present invention has been made in view of the foregoing circumstances. It is an object of the present invention to provide a steel material, such as a high-strength spring with excellent fatigue properties, and, more specifically, a steel material, such as the high-strength spring that can improve the fatigue properties in a high-strength region more easily, without increasing an alloy cost. The term "high-strength" as used in the present invention means an internal hardness of a steel wire or spring of 600 or more in terms of Vickers hardness (HV), in which the toughness and ductility might be reduced by increasing strength. The upper limit of the Vickers hardness (HV) is about 670 or less. The present invention is to enhance fatigue properties of a steel material in such a high-strength region, that is, to enhance the fatigue properties of a steel material such as a spring to which a high-fatigue load is applied.

Means for Solving the Problems

A high-strength steel material with excellent fatigue properties according to the present invention that can solve the above-mentioned problem includes, in percent by mass, C: 0.5 to 1.0%,
Si: 1.5 to 2.50%,
Mn: 0.5 to 1.50%,
P: more than 0% to 0.020% or less,
S: more than 0% to 0.020% or less, Cr: more than 0% to 0.2% or less, Al: more than 0% to 0.010% or less, N: more than 0% to 0.0070% or less, and O: more than 0% to 0.0040% or less, and the balance consisting of iron and inevitable impurities, wherein Cr and Si contents satisfy a formula of $Cr \times Si \leq 0.20$, a ratio of tempered martensite in a steel microstructure is 80% or more by area, and a number density of particles of Cr-containing carbide or carbonitride having a circle-equivalent diameter of 50 nm or more in the steel microstructure is 0.10 particles/$\mu m^2$ or less.

The steel material may further contain, as other elements, in percent by mass, one or more elements selected from the group consisting of Ni: more than 0% to 0.30% or less, V: more than 0% to 0.30% or less, and B: more than 0% to 0.0100% or less.

Effects of the Invention

The present invention can achieve the steel material such as the high-strength spring with excellent fatigue properties. In particular, the present invention can achieve the steel material, such as the high-strength spring that improves the fatigue properties in the high-strength region more easily, without increasing the alloy cost.

MODE FOR CARRYING OUT THE INVENTION

Figure 1:
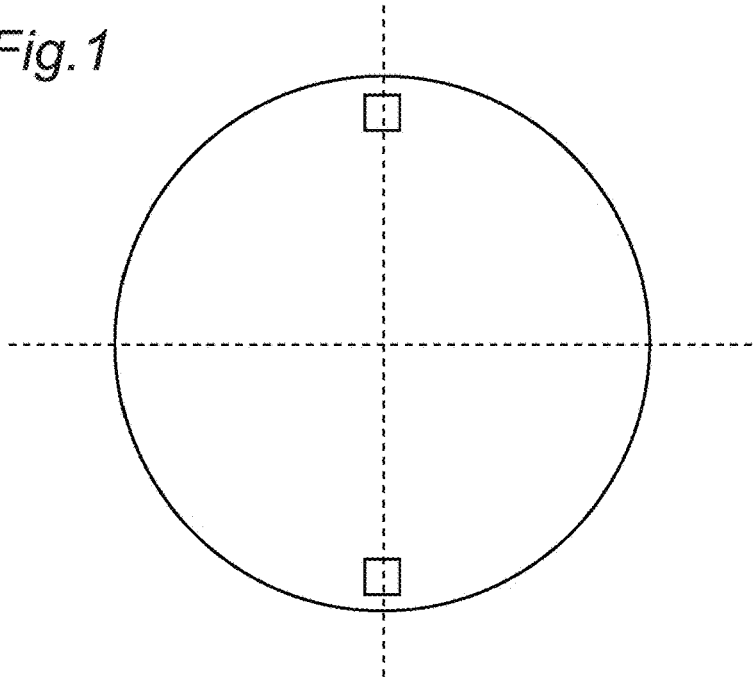
FIG. 1 is a diagram for explaining measurement points of a Cr-containing carbide or carbonitride in Examples.
Figure 2A:
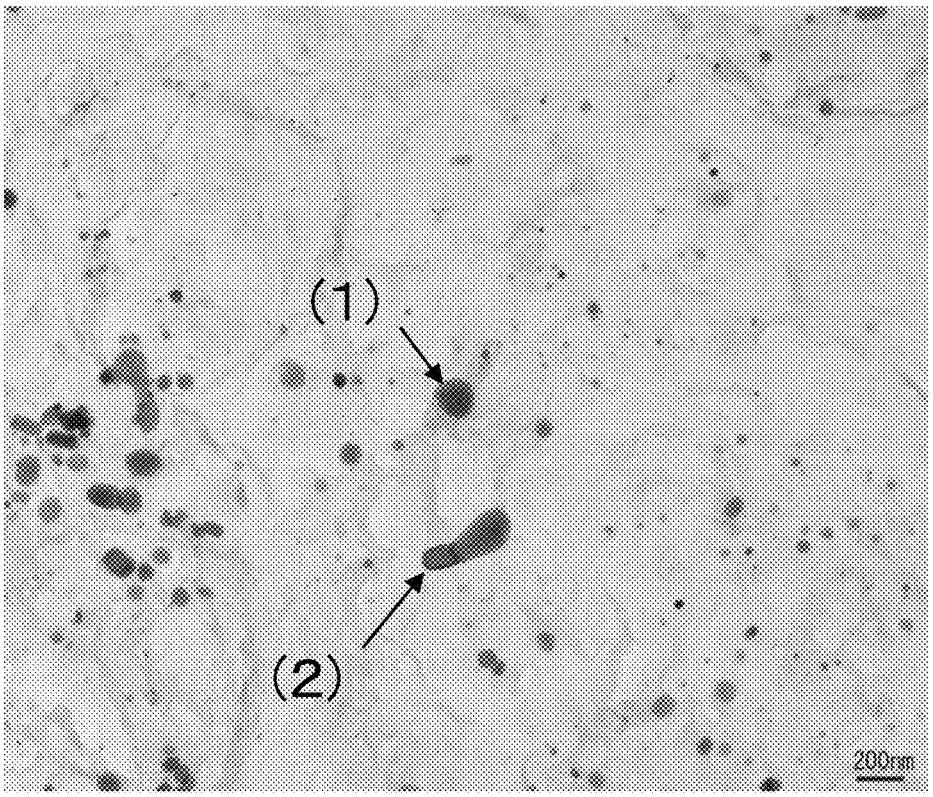
FIG. 2A is a TEM (transmission electron microscope) image of a comparative example in Examples.
Figure 2B:
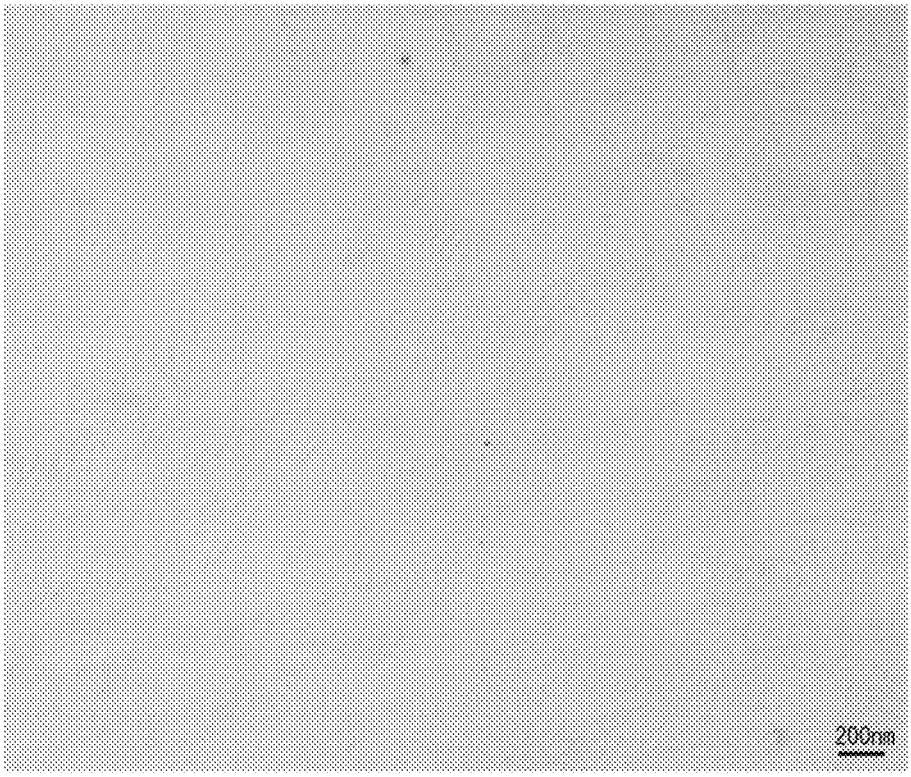
FIG. 2B is a TEM image of an inventive example in Examples.
Figure 3A:
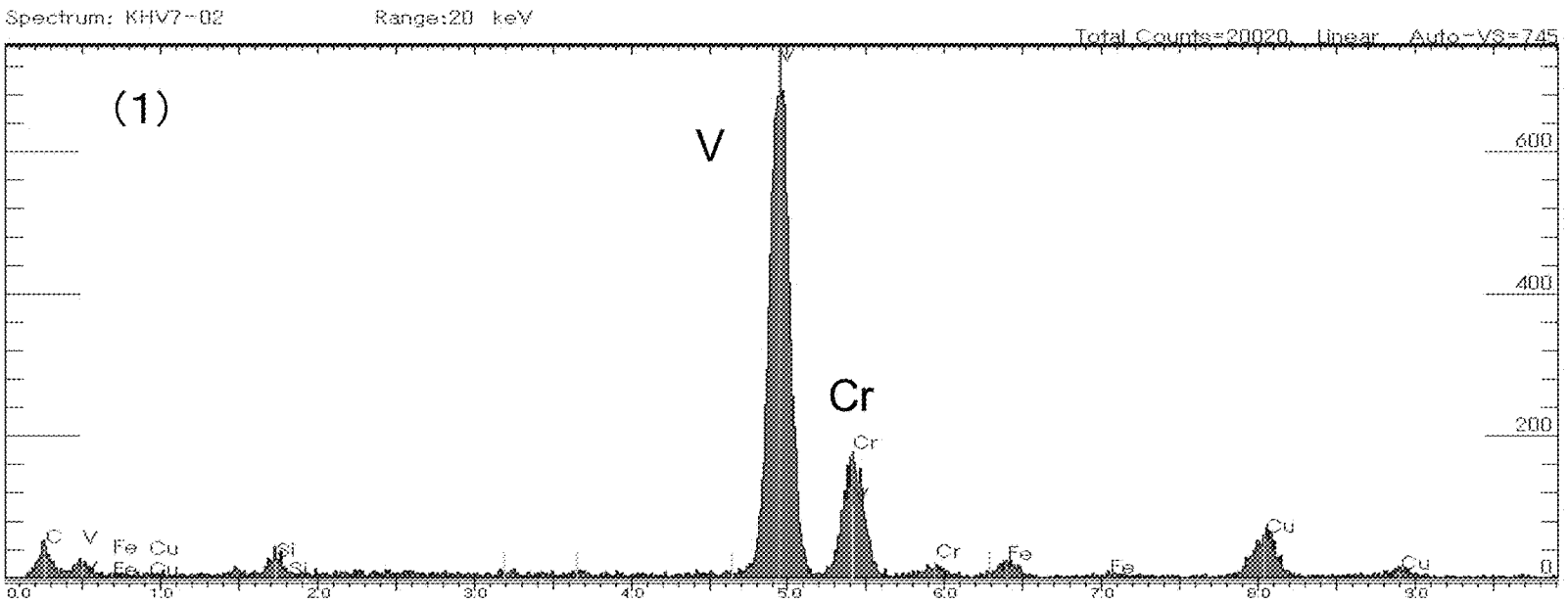
FIG. 3A is an EDX (energy dispersive X-ray spectrometry) analysis result of an inclusion (1) in the TEM image shown in FIG. 2A.
Figure 3B:
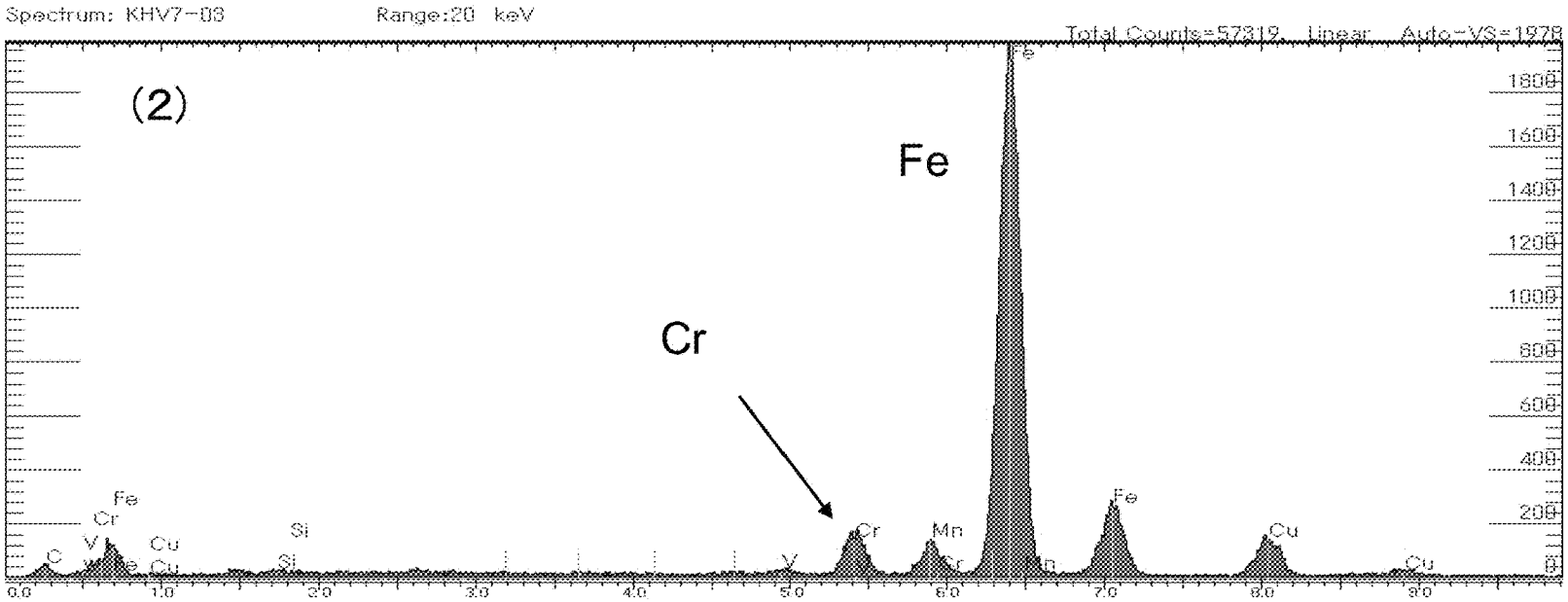
FIG. 3B is an EDX analysis result of an inclusion (2) in the TEM image shown in FIG. 2A.

The inventors have studied high-strength springs from various points of view to improve the fatigue properties of the springs by suppressing fatigue failure due to internal defects such as inclusions, which failure has increased in recent years. As a result, the following findings are obtained.

Many studies have been conventionally done by focusing on inclusions to suppress the fatigue failure of springs. Specifically, regarding the above-mentioned inclusions, some studies have proposed to control the composition and form of an oxide based inclusion such as alumina or silica. However, the present inventors have thought that in order to improve the fatigue properties in the high-strength region, specifically, to suppress the fatigue failure starting from an internal defect such as the inclusion in a microstructure including mainly a tempered martensite, it is effective to restrain a growth rate of a fatigue crack generated from the internal defect such as the inclusion and then grown. Specifically, the inventors have diligently studied the precipitation form of a Cr-containing carbide or carbonitride to restrain the fatigue crack growth rate by focusing on the fact that an interface between a base material and the Cr-containing carbide or carbonitride precipitated as a hard inclusion in the steel microstructure tends to become a growth route of a fatigue crack.

The result shows that under the presence of Cr-containing carbide or carbonitride with a circle-equivalent diameter of 50 nm or more, the interface between the base material and the particle of the Cr-containing carbide or carbonitride tends to be the growth route of the fatigue crack. Furthermore, it shows that the presence of the Cr-containing carbide or carbonitride particles with the above-mentioned size at a density more than 0.10 particles/$\mu m^2$ tends to promote the growth of the fatigue crack, degrading the fatigue properties. That is, in the present invention, the number density of particles of the Cr-containing carbide or carbonitride with the above-mentioned size is set at 0.10 particles/$\mu m^2$ or less, thereby making it possible to suppress the fatigue failure in the high-strength region, thus providing a spring and steel wire for a spring with the high strength and excellent fatigue properties. The number density of particles of the Cr-containing carbide or carbonitride with the above-mentioned size can be set at 0.10 particles/$\mu m^2$ or less, resulting in no fatigue failure, as shown in examples to be mentioned later. Furthermore, the number density is preferably set at 0.08 particles/$\mu m^2$ or less, more preferably at 0.06 particles/$\mu m^2$ or less, and most preferably at 0 particle/$\mu m^2$ from the viewpoint of further suppressing the fatigue failure starting from the Cr-containing carbide or carbonitride even in an ultralong lifetime region (after hundreds of millions of times of vibration with an amplitude).

The term "Cr-containing carbide or carbonitride", which is a subject matter of the present invention, is a carbide or carbonitride having a ratio of Cr in the total metal elements except for Fe of 10% or more by mass determined by quantitative analysis of the elements forming the carbide or carbonitride by the EDX, as shown later in the measurements in Examples. The metal elements forming the Cr-containing carbide or carbonitride can include V, Fe and the like in addition to Cr. The Cr-containing carbide or carbonitride does not include a complex inclusion including a combination of the above-mentioned carbide or carbonitride and an oxide, a sulfide and the like. The conditions for measurement by the EDX are as follows: acceleration voltage of 20 kV, and time of 60 seconds.

To ensure the high strength and the setting resistance, fatigue properties and the like as spring characteristics, together with the control of the inclusion, it is necessary to specify the component composition of the spring and the steel material such as the steel wire for the spring within the range below. The reasons for specifying the contents of respective components will be described below.

C: 0.5 to 1.0%

Carbon (C) is an element effective in improving the strength and setting resistance of a spring. To achieve this, the C content needs to be 0.5% or more, preferably 0.55% or more, and more preferably 0.60% or more. As the C content increases, the strength and setting resistance of the spring are improved. However, any excessive C content precipitates a large amount of coarse cementite, adversely affecting the spring workability and spring characteristics. Therefore, the upper limit of C content is set at 1.0% or less. The C content is preferably 0.9% or less, and more preferably 0.8% or less.

Si: 1.5 to 2.50%

Silicon (Si) is an element effective in improving the deoxidation of steel, and the strength and setting resistance of the spring. To exhibit these effects, the Si content needs to be 1.5% or more. The Si content is preferably 1.8% or more, and more preferably 1.9% or more. However, any excessive Si content not only hardens the material, but also degrades the ductility and toughness of the steel material, and further expands a decarburized region on the surface of the steel material, degrading the shaving processability and fatigue properties thereof. Thus, the Si content needs to be 2.50% or less. The Si content is preferably 2.40% or less, and more preferably 2.30% or less.

Mn: 0.5 to 1.50%

Manganese (Mn) is an element effective not only in deoxidation of the steel, but also in fixing S contained in the steel as MnS. Additionally, Mn is the element that enhances the hardenability of the steel material and contributes to improving the spring strength. To exhibit these effects, the Mn content needs to be 0.5% or more. The Mn content is preferably 0.6% or more, and more preferably 0.7% or more. However, any excessive Mn content improves the hardenability too much and is more likely to form a supercooled microstructure such as martensite, bainite and the like. Therefore, the Mn content needs to be 1.50% or less. The Mn content is preferably 1.40% or less, and more preferably 1.30% or less.

P: More than 0% to 0.020% or Less

Phosphorus (P) is an element that segregates in a prior austenite grain boundary to make the steel microstructure brittle, leading to degradation in the fatigue properties. Thus, the P content is preferably set at 0.020% or less, and preferably 0.018% or less.

S: More than 0% to 0.020% or Less

Like P, Sulfur (S) is an element that segregates in a prior austenite grain boundary to make the steel microstructure brittle, leading to degradation in the fatigue properties. Thus, the S content is set at 0.020% or less, and preferably 0.015% or less.

Cr: More than 0% to 0.2% or Less

Chromium (Cr) has the effects of improving the hardenability and spring strength, and of preventing the decarburization during rolling or a heat treatment by reducing the activity of C. To exhibit these effects, the Cr content is preferably set at 0.02% or more, and more preferably 0.03% or more. However, as mentioned above, in a steel material to which a high fatigue load is applied, the interface between the base material and the Cr-containing carbide or carbonitride is considered to become a growth route of a fatigue crack, which might cause an increase in fatigue crack growth rate. Thus, it is necessary to suppress the formation of the Cr-containing carbide or carbonitride. Therefore, the Cr content is set at 0.2% or less. The Cr content is preferably 0.15% or less, and more preferably 0.12% or less.

Al: More than 0% to 0.010% or Less

Aluminum (Al) is a deoxidation element and forms inclusions such as $Al_2O_3$ and AlN in the steel material. These inclusions drastically reduces the fatigue lifetime of the spring. Thus, the Al content should be reduced as much as possible. Therefore, the Al content is suppressed to 0.010% or less. The Al content is preferably set at 0.005% or less.

N: More than 0% to 0.0070% or Less

Nitrogen (N) binds to Al to form an AlN inclusion. The AlN inclusion drastically reduces the fatigue lifetime of the spring. To suppress the formation of the AlN inclusion, it is necessary to decrease the N content as much as possible. N is an element that promotes aging embrittlement during a wire drawing process, making it difficult to perform secondary processing. From these viewpoints, the N content is set at 0.0070% or less. The N content is preferably 0.0050% or less, and more preferably 0.0040% or less.

O: More than 0% to 0.0040% or Less

Any excessive oxygen (O) content forms coarse nonmetal inclusions, degrading the fatigue strength of the steel material. Therefore, the O content is set at 0.0040% or less. The O content is preferably 0.0030% or less, and more preferably 0.0025% or less.

The basic components of the steel material in the present invention have been mentioned above, and the balance is iron and inevitable impurities. The inevitable impurities are allowable that are brought into the steel material, depending on raw material, building materials, manufacturing equipment and the like. In addition to the above-mentioned basic components, one or more elements selected from the group consisting of Ni, V and B are included in the following amounts, thereby further enabling the improvement of the toughness, ductility and the like of the steel material.

Ni: More than 0% to 0.30% or Less

Nickel (Ni) is an element that improves the hardenability to thereby contribute to increasing the strength of the steel material by a heat treatment. Ni suppresses the precipitation of carbides which is generated by the tempering and thus has the effect of suppressing degradation in the toughness and ductility. To exhibit these effects, the Ni content is preferably set at 0.05% or more, and more preferably 0.10% or more. However, any excessive Ni content makes the steel material inferior in cost, and enhances the hardenability too much, which facilitates the formation of the supercooled microstructure such as martensite, bainite and the like. Further, such an excessive Ni content forms an extremely large amount of residual austenite through the quenching and tempering, drastically degrading the setting resistance of the spring. Thus, the Ni content is preferably 0.30% or less, more preferably 0.25% or less, and further preferably 0.20% or less.

V: More than 0% to 0.30% or Less

Vanadium (V) has the function of refining crystal grains during the hot-rolling, quenching and tempering, thus contributing to improvement of the ductility and toughness. During stress relief annealing after forming a spring, secondary precipitation hardening occurs, which contributes to improve the strength of the spring. To exhibit these effects, the V content is preferably 0.03% or more, and more preferably 0.07% or more. However, any excessive V content precipitates an extremely large amount of carbide or carbonitride containing V and Cr, that is, the Cr-containing carbide or carbonitride specified by the present invention, which reduces the fatigue strength of the steel material. Therefore, the V content is preferably 0.30% or less, more preferably 0.25% or less, and further preferably 0.20% or less. The above-mentioned V element could form a hard carbide other than the specified Cr-containing carbide/carbonitide. Such a hard carbide is confirmed not to adversely affect the shaving processability when manufacturing a wire rod under recommended conditions to be mentioned later using the respective components satisfying the scope specified by the present invention.

B: More than 0% to 0.0100% or Less

Boron (B) has the effect of improving the hardenability as well as the ductility and toughness of a steel material by cleaning a crystal grain boundary of austenite. To exhibit these effects, the B content is preferably 0.0010% or more, more preferably 0.0015% or more, and further preferably 0.0020% or more. However, any excessive B content precipitates a complex compound of Fe and B, causing cracks during hot-rolling in some cases. Furthermore, such an excessive B content improves the hardenability too much and is more likely to form a supercooled microstructure such as martensite, bainite and the like. Thus, the B content is preferably 0.0100% or less, more preferably 0.0080% or less, and further preferably 0.0060% or less.

$Cr \times Si \leq 0.20$

To ensure the fatigue strength, the hardness of the steel material needs to be enhanced. However, when the steel material has an excessively high hardness, the toughness and ductility of the steel material is reduced, which makes it more likely to cause the fatigue failure starting from an internal defect such as an inclusion. In the present invention, in order to increase the internal hardness of the steel material, it is effective to increase the Si content. However, any large Si content easily leads to the fatigue failure starting from an internal defect. Thus, for suppressing such fatigue failure, the Cr content is controlled in accordance with the Si content, thereby suppressing the formation of the hard Cr-containing carbide or carbonitride that would otherwise serve as the growth route of a fatigue crack. This improves the fatigue strength. From this viewpoint, in the present invention, the Si content and the Cr content in percent by mass in the steel material satisfies a formula of $Cr \times Si \leq 0.20$. The value of $Cr \times Si$ is preferably 0.18 or less, and more preferably 0.15 or less. If the value of $Cr \times Si$ is too low, the effects of the respective alloy elements cannot be exhibited. Thus, the lower limit of $Cr \times Si$ is preferably 0.07 or more.

The steel material in the present invention mainly has a tempered martensite microstructure in which the ratio of tempered martensite in the steel microstructure is 80% or more by area. A microstructure obtained by tempering the residual austenite can be contained at 20% or less by area as other than the tempered martensite.

A method for manufacturing the steel material in the present invention can be the following one. That is, after obtaining a steel ingot by a general method, the ingot is subjected to blooming, wire-rolling and winding, followed by a shaving process for removing a decarburization layer and defect at a surface layer of the rolled material, as a secondary process. The shaving process will be hereinafter referred to as an SV process. Then, as a heat treatment, an annealing treatment by high-frequency heating (IH, Induction Heating) is performed for softening only the processed surface layer generated by the shaving process. Alternatively, as a heat treatment, a patenting treatment (FBP, Fluidized Bed Patenting) is performed to transfer the entire microstructure including the surface into a pearlite single-phase microstructure or a mixed microstructure of pearlite and either ferrite or cementite. After such a heat treatment, pickling and then forming a lubricating coating are performed. Then, as indicated in step A below, a method includes wire drawing, quenching and tempering (oil temper), and spring-coiling at an ordinary temperature. Alternatively, as indicated in step B below, a method includes wire drawing, spring-coiling at an ordinary temperature, and quenching and tempering (oil temper).

Wire drawing→Quenching and Tempering (Oil Temper)*1→Spring-coiling at Ordinary Temperature*2 Step A:

Wire drawing→Spring-coiling at Ordinary Temperature→Quenching and Tempering (Oil Temper) Step B:

The steel wire for a spring as the steel material of the present invention is obtained by performing process *1 in the above-mentioned step A, that is, the wire drawing, and the quenching and tempering (oil temper) in this order. The spring using the above-mentioned steel wire for a spring as the steel material of the present invention is obtained by performing the process *2 in the above-mentioned step A, that is, the wire drawing, the quenching and tempering (oil temper), and the spring-coiling in this order. The spring obtained through the step is hereinafter sometimes referred to as a spring A. Further, the steel material of the present invention includes the spring obtained in the step B. The spring obtained through the step B is hereinafter sometimes referred to as a spring B. When manufacturing the spring, after the spring-coiling process, bluing, shot-peening, stress relief annealing, setting and the like are performed as commonly done.

In each of the above-mentioned steel wire for a spring, the spring A and the spring B, to achieve the number density of particles of the Cr-containing carbide or carbonitride specified by the present invention, the above-mentioned blooming, wire-rolling, annealing or patenting treatment as a heat treatment, and quenching and temperature (oil temper) are recommended to be performed to satisfy the following conditions. The recommended conditions in the respective steps will be described below.

(1) Blooming

In the blooming step, the Cr-containing carbide or carbonitride needs to be heated at 1,200° C. or higher before performing a blooming process so as to sufficiently solid-solute the Cr-containing carbide or carbonitride. The heating temperature is preferably 1,220° C. or higher. On the other hand, considering a heatproof temperature of a heating furnace or the like, the heating temperature is preferably 1,300° C. or lower, and more preferably 1,280° C. or lower.

(2) Wire-Rolling

In the wire-rolling step, it is important to suppress the formation and growth of particles of the Cr-containing carbide or carbonitride, while suppressing the formation of a supercooled microstructure and the excessive carburization that would otherwise adversely affect the processing step after the wire-rolling. From these viewpoints, heating temperatures and the like before the wire-rolling are controlled as follows.

Heating Temperature before Wire Rolling

To suppress the formation and growth of particles of the Cr-containing carbide or carbonitride, the heating temperature before the wire-rolling is set at 1,100° C. or lower, and preferably 1,050° C. or lower. However, the excessively low heating temperature makes it difficult to perform the wire-rolling because of a high deformation resistance of the steel material. Therefore, the heating temperature is set at 800° C. or higher, and preferably 850° C. or higher.

Coiling Temperature

When a coiling temperature is too high, the formation and growth of particles of the Cr-containing carbide or carbonitride are promoted. Thus, the coiling temperature is set at 1,000° C. or lower, and preferably 950° C. or lower. On the other hand, since the cooling capacity of a facility is limited, the coiling temperature is 750° C. or higher, and preferably 800° C. or higher. The above-mentioned coiling temperature can be called a "conveyor placing temperature after finish rolling".

Controlled Cooling after Coiling

As described below, the controlled cooling is performed on a conveyor after the coiling in the way below, so as to be a pearlite single-phase microstructure, or a mixed microstructure of pearlite and either ferrite or cementite, which is suitable for the secondary processing, while suppressing the formation and growth of particles of the Cr-containing carbide or carbonitride.

Average Cooling Rate to a Temperature of 600° C. after Coiling

By controlling an average cooling rate to 1.0° C./sec or more after coiling or after conveyor placing until a pearlite transformation finishing temperature range of 600° C., the formation and growth of particles of the Cr-containing carbide or carbonitride can be suppressed. The average cooling rate is more preferably 2.0° C./sec or more. On the other hand, if the average cooling rate becomes too high, the supercooled microstructure such as martensite will be formed, making it difficult to obtain the pearlite single-phase microstructure, or the mixed microstructure of pearlite and either ferrite or cementite. In the secondary process as a post-process, the wire is more likely to be broken. Therefore, the average cooling rate is 6° C./sec or less, and preferably 5° C./sec or less.

Average Cooling Rate at Temperatures Ranging from 600° C. to 300° C.

In addition to the control of cooling to 600° C. as mentioned above, an average cooling rate at temperatures ranging from 600° C. to 300° C. is set at 4° C./sec or more, whereby the formation and growth of particles of the Cr-containing carbide or carbonitride in this temperature range can be suppressed. The average cooling rate is preferably 5° C./sec or more. On the other hand, if the average cooling rate becomes too high in this temperature range, the supercooled microstructure such as martensite, will be formed, making it difficult to obtain the pearlite single-phase microstructure, or the mixed microstructure of pearlite and either ferrite or cementite. In the secondary process as a post-process, the wire is more likely to be broken. Therefore, the average cooling rate is 10° C./sec or less, and preferably 9° C./sec or less in this temperature range.

Method for Controlling Cooling Rate

The control of the cooling rate on the conveyor, which includes the control of the average cooling rate after the coiling to a temperature of 600° C. as well as the control of the average cooling rate at temperatures ranging from 600° C. to 300° C. can be performed by a combination of a wire rolling rate, a conveyor speed, blower cooling, cover cooling and the like. The temperature of the wire rod on the conveyor is measured by radiation thermometers located at a plurality of positions over the conveyor. The measured values obtained in this measurement are used to calculate the average cooling rate after the coiling to 600° C., as well as the average cooling rate at temperatures ranging from 600° C. to 300° C. Cooling condition from 300° C. to the room temperature is not particularly limited, and for example, allowing to cool can be applied.

(3-1) Patenting Treatment

The heating temperature in the patenting treatment is set at 880° C. or higher to prevent non-dissolved microstructures from remaining in the steel material, and preferably 900° C. or higher. If the heating temperature is too high, the formation and growth of particles of the Cr-containing carbide or carbonitride are promoted. Thus, the heating temperature is set at 950° C. or lower and preferably 930° C. or lower. For an extremely short holding time at the heating temperature, the non-dissolved microstructure tends to remain. Thus, the holding time is set at 120 seconds or more, and preferably 140 seconds or more. On the other hand, if the holding time is too long, the formation and growth of particles of the Cr-containing carbide or carbonitride are promoted. Thus, the holding time is set at 300 seconds or less, and preferably 280 seconds or less.

After holding the heating, the average cooling rate to a temperature of 600° C. is set at 1.0° C./sec or more, thereby making it possible to suppress the formation and growth of particles of the Cr-containing carbide or carbonitride. The average cooling rate is preferably 2.0° C./sec or more. On the other hand, the excessively high average cooling rate makes it difficult obtain the pearlite single microstructure, or the mixed microstructure of pearlite and either ferrite or cementite, which is suitable for the post-process. Thus, the steel material should be cooled at an average cooling rate of 6° C./sec or less, and preferably 5° C./sec or less. Cooling condition from 600° C. to the room temperature is not particularly limited, and for example, allowing to cool can be applied.

(3-2) Annealing Treatment by High-Frequency Heating

In annealing treatment by high-frequency heating, the upper limits of heating temperature and heating holding time are the same as those in the patenting treatment from the viewpoint of suppressing the formation and growth of particles of the Cr-containing carbide or carbonitride, and ensuring the formation of the pearlite single microstructure, or the mixed microstructure of pearlite and either ferrite or cementite, which is suitable for the post-process. If the heating temperature is too high, the microstructure is made spherical, and the breaking could occur in the wire drawing process. Thus, the upper limit of heating temperature is more preferably 800° C. or lower, and further preferably 770° C. or lower. The lower limit of heating temperature is preferably 600° C. or higher. The upper limit of holding time is more preferably 20 seconds or less, and further preferably 15 seconds or less. The lower limit of holding time is preferably 5 seconds or more in view of the softening of the hardened surface layer. After the heating, the steel material may be cooled with water to the room temperature.

(4) Quenching and Tempering (Oil Temper)

As mentioned in the description about the steps A and B, there are the step of spring-coiling at an ordinary temperature after quenching and tempering, and the step of quenching and tempering after spring-coiling at an ordinary temperature. In either case, the heating temperature for the quenching process is set at 850° C. or higher to prevent non-dissolved microstructures from remaining in the steel material, and preferably 870° C. or higher. On the other hand, the heating temperature for the quenching process is set at 1,000° C. or lower, and preferably 950° C. or lower in terms of suppressing the formation and growth of particles of the Cr-containing carbide or carbonitride. The holding time at the above-mentioned heating temperature is set at 60 seconds or more to prevent the non-dissolved microstructures from remaining in the steel material, and preferably 70 seconds or more. In contrast, if a holding time is too long, the formation and growth of particles of the Cr-containing carbide or carbonitride are promoted. Thus, the holding time is set at 120 seconds or less, and preferably 110 seconds or less. After the heating, oil quenching is performed. Thereafter, the tempering may be performed at a temperature in a range of 400° C. or higher and 500° C. or lower in a batch furnace in such a manner as to set the internal hardness of the steel material at 600 or more and 670 or less in terms of Vickers hardness.

The present application claims priority on Japanese Patent Application No. 2014-073605, filed on Mar. 31, 2014 as a basic application, the disclosure of which is incorporated by reference herein.

EXAMPLES

The present invention will be more specifically described below by way of Examples, but is not limited to the following Examples. Various modifications can be made to these Examples as long as they are adaptable to the above-mentioned and below-mentioned concepts and are included within the technical scope of the present invention. That is, in the present invention, regardless of the order of the quenching and tempering processes and the spring-coiling process in the manufacturing procedure, the excellent fatigue properties can be exhibited by controlling the number density of particles of the Cr containing carbide or carbonitride as specified by the present invention. Thus, in the examples, a steel wire for a spring is a subject for evaluation as one example of the steel material according to the present invention. However, the same properties as those of the above-mentioned steel wire for a spring can also be obtained from a spring produced by spring-coiling this steel wire, or a spring subjected to the quenching and tempering processes and the spring-coiling process in the reverse order with respect to that of the above-mentioned spring.

A steel ingot satisfying a chemical component composition shown in Table 1 was obtained by molting and casting with a converter furnace. Then, the obtained steel ingot was heated to a "pre-blooming heating temperature" shown in Table 2, followed by the blooming to produce a billet. Subsequently, the billet was heated to a "pre-wire-rolling heating temperature" shown in Table 2, followed by the hot-rolling and then coiling at a "coiling temperature" shown in Table 2. Then, cooling at an "average cooling rate to a temperature of 600° C. after the coiling" and an "average cooling rate at temperatures ranging from 600° C. to 300° C." were carried out, thereby producing a wire rod, i.e. a coil, having a diameter of 8.0 mm and a weight of 2 tons. Thereafter, a decarburization layer and defect were removed from a surface layer of the wire rod by the SV process. Next, a patenting treatment or high-frequency heating was performed under the conditions shown in Table 2, as a heat treatment. In a column "method" of "heat treatment conditions" shown in Table 2, the patenting treatment is referred to as "FBP", and the high-frequency heating is referred to as "IH". The "average cooling rate" in the "heat treatment conditions" shown in Table 2 indicates an average cooling rate from a heating temperature to 600° C. in the above-mentioned patenting treatment. In the high-frequency heating, cooling after heating to the room temperature was carried out by water cooling. In a column "average cooling rate" for the high-frequency heating in the "heat treatment conditions", a symbol "-" is shown in Table 2.

When performing the patenting treatment as the heat treatment, the steel microstructure became a pearlite single-phase microstructure, or a mixed microstructure of pearlite and either ferrite or cementite. When performing the high-frequency heating, in the steel microstructure, the hardened surface layer generated by the SV process was annealed, and the inside of the steel material became the pearlite single-phase microstructure, or the mixed microstructure of pearlite and either ferrite or cementite.

Then, the wire rod was subjected to a cold wire drawing process so as to have a diameter of 4.0 mm.

Further, heating is carried out at the heating temperature for the holding time for quenching shown in Table 2, and then subjected to the oil quenching, followed by tempering at a temperature ranging from 400 to 500° C., thereby producing a steel material, i.e. a steel wire for a spring, that mainly included a tempered martensite microstructure. A symbol "-" in sample No. 27 as shown in Table 2 indicates that cracks occurred in a hot-rolled material, and no other steps and evaluations were performed thereafter. In each example, the ratio of tempered martensite in the steel microstructure was 80% or more by area, which was confirmed by using the quenched microstructure by an X-ray diffraction method for measuring a residual γ amount.

Using the obtained steel materials, the number density of particles of the Cr-containing carbide or carbonitride was measured, and the fatigue properties thereof was evaluated in the following ways.

Measurement of the Number Density of Particles of Cr-Containing Carbide or Carbonitride When observing the particles of Cr-containing carbide or carbonitride existing in the steel microstructures, first, specimens for observing with a microscope were fabricated by an extraction replica method mentioned below. Specifically, as indicated by an outlined square in FIG. 1, observation samples were taken from two parts of a steel wire located on a section (cross-section) perpendicular to the rolling direction at a depth of 300 μm from its outermost surface and positioned symmetrically via an axis center. Then, each sample was cut, subjected to mechanical polishing, electropolishing, etching, carbon vapor deposition, peeling and cleaning in this order, thereby fabricating the above-mentioned specimen. The electropolishing used 10% perchloric acid-90% ethanol as an electrolytic solution; the etching used 10% acetylacetone-90% methanol-1% by mass tetramethylammonium chloride as an etchant; and the peeling used 1% nitric acid-99% methanol as a remover.

The Cr-containing carbide or carbonitride of the specimen fabricated by the extraction replica method was observed by a field emission gun transmission electron microscope HF-2000, manufactured by HITACHI HIGH-TECHNOLOGIES Corporation, under the following conditions: an acceleration voltage of 200 kV; a reproduction ratio of 20,000×; and a total magnification of 30,000×. Whether a Cr-containing carbide or carbonitride was a target one or not was determined by an EDX analyzer Sigma, manufactured by KEVEX Corporation, included in the TEM device. The conditions for measurement by the energy-dispersive X-ray (EDX) were as follows: acceleration voltage of 20 kV, and time of 60 seconds. In detail, quantitative analysis was performed using EDX on the constituent elements of a carbide or carbonitride, whereby the "Cr-containing carbide or carbonitride" of the subject matter of the present invention was defined as the carbide or carbonitride in which a ratio of Cr relative to the total metal elements except for Fe was 10% or more by mass.

Three TEM observation images were taken for each part shown in FIG. 1, that is, the total of six images were taken for each test piece No. shown in Table 2. Examples of the TEM observation images and EDX analysis results of the Cr-containing carbide or carbonitride in the TEM observation images were shown in FIGS. 2A, 2B, 3A and 3B.

After identifying the above-mentioned Cr-containing carbide or carbonitride, the number of particles of the Cr-containing carbide or carbonitride having a circle-equivalent diameter of 50 nm or more was determined by an image analysis software, Image Pro Plus manufactured by MEDIA CYBERNETICS, Inc. The measured number was converted into the number of particles per $\mu m^2$. In this way, the number density of particles of the Cr-containing carbide or carbonitride having a circle-equivalent diameter of 50 nm or more was determined. Regarding each test piece No. shown in Table 2, the number densities were measured by the six TEM observation images, and an average number density was then calculated and defined as the number density of particles of Cr-containing carbide or carbonitride.

Evaluation of Fatigue Properties

The obtained steel wires were used and subjected to a Nakamura-type rotating-bending fatigue test, thus evaluating the fatigue properties. First, each steel wire obtained was subjected to shot-peening, and a compressive residual stress was applied to the surface layer of the steel wire, followed by stress relief annealing at 220° C. for 20 minutes, thus producing a sample. Ten samples of each test piece No. shown in Table 2 were subjected to the fatigue test under the following conditions: a test stress of 1000 MPa, and the number of terminating the test of 30 million times. A test piece having all 10 samples capable of withstanding the repeated test 30 million times, as the number of terminating the test, was determined to have excellent fatigue properties with an inclusion breakage rate of 0%; and a test piece having 10 samples, at least one of which was broken by the end of terminating the test after repetition 30 million times as the number of terminating the test, that is, a test piece having an inclusion breakage rate of 10% or more was determined to have inferior fatigue properties. Samples getting surface cracks in this fatigue test were not counted and a retesting was performed to compensate for such samples.

Evaluation of Internal Hardness

Figure 4:
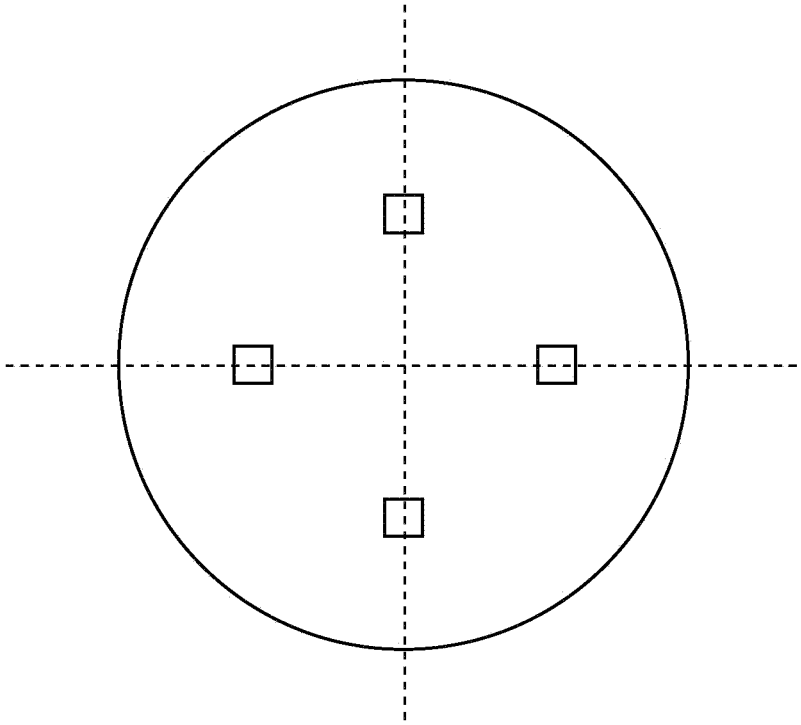
FIG. 4 is a diagram for explaining measurement points of an internal hardness in Examples.

As illustrated by outlined squares in FIG. 4, the Vickers hardness (HV) was measured under a test load of 10 kgf on four parts of the steel wire located in D/4 positions of the diameter thereof, the respective parts being spaced apart from each other by 90° relative to the axis center.

These results are shown in Table 2.

TABLE 1

| Steel | Chemical component composition (% by mass) the balance being iron and inevitable impurities | | | | | | | | | | | | |
|---|---|---|---|---|---|---|---|---|---|---|---|---|---|
| Symbol | C | Si | Mn | P | S | Cr | Al | N | O | Ni | V | B | Cr × Si |
| A | 0.70 | 1.99 | 0.97 | 0.018 | 0.007 | 0.04 | 0.002 | 0.0045 | 0.0013 | — | — | — | 0.08 |
| B | 0.73 | 2.21 | 1.03 | 0.016 | 0.006 | 0.07 | 0.003 | 0.0038 | 0.0011 | — | — | — | 0.15 |
| C | 0.65 | 1.81 | 1.21 | 0.012 | 0.009 | 0.11 | 0.006 | 0.0040 | 0.0007 | 0.11 | — | — | 0.20 |
| D | 0.57 | 1.90 | 1.21 | 0.011 | 0.009 | 0.06 | 0.003 | 0.0041 | 0.0026 | — | — | — | 0.11 |
| E | 0.73 | 2.05 | 0.76 | 0.013 | 0.011 | 0.05 | 0.002 | 0.0036 | 0.0016 | — | — | 0.0041 | 0.10 |
| F | 0.68 | 2.10 | 1.03 | 0.009 | 0.008 | 0.06 | 0.003 | 0.0044 | 0.0016 | 0.18 | — | 0.0033 | 0.13 |
| G | 0.77 | 2.13 | 0.95 | 0.014 | 0.006 | 0.05 | 0.004 | 0.0038 | 0.0022 | — | 0.11 | — | 0.11 |
| H | 0.81 | 2.08 | 0.64 | 0.011 | 0.006 | 0.07 | 0.003 | 0.0048 | 0.0018 | — | 0.23 | 0.0037 | 0.15 |
| I | 0.55 | 2.33 | 1.05 | 0.018 | 0.008 | 0.08 | 0.002 | 0.0038 | 0.0017 | — | — | — | 0.19 |
| J | 0.71 | 1.73 | 1.39 | 0.016 | 0.011 | 0.11 | 0.004 | 0.0033 | 0.0023 | 0.08 | 0.19 | 0.0026 | 0.19 |
| K | 1.07 | 1.95 | 0.95 | 0.018 | 0.008 | 0.08 | 0.005 | 0.0033 | 0.0011 | — | — | — | 0.16 |
| L | 0.77 | 2.54 | 0.89 | 0.011 | 0.008 | 0.06 | 0.003 | 0.0032 | 0.0011 | — | 0.11 | — | 0.15 |
| M | 0.58 | 2.11 | 1.55 | 0.016 | 0.004 | 0.06 | 0.003 | 0.0041 | 0.0021 | — | — | 0.0038 | 0.13 |
| O | 0.64 | 1.89 | 1.05 | 0.013 | 0.005 | 0.35 | 0.002 | 0.0038 | 0.0021 | — | — | — | 0.66 |
| P | 0.68 | 2.02 | 0.79 | 0.013 | 0.004 | 0.07 | 0.004 | 0.0032 | 0.0022 | — | 0.34 | — | 0.14 |
| Q | 0.66 | 1.99 | 1.21 | 0.013 | 0.003 | 0.06 | 0.018 | 0.0037 | 0.0018 | — | — | — | 0.12 |
| R | 0.66 | 1.68 | 1.11 | 0.015 | 0.007 | 0.10 | 0.003 | 0.0033 | 0.0019 | 0.15 | 0.09 | 0.0116 | 0.17 |
| S | 0.58 | 2.12 | 0.98 | 0.011 | 0.006 | 0.13 | 0.005 | 0.0029 | 0.0018 | — | — | — | 0.28 |
| T | 0.71 | 1.89 | 1.03 | 0.013 | 0.005 | 0.15 | 0.008 | 0.0041 | 0.0011 | 0.11 | — | 0.0041 | 0.28 |

TABLE 2

| Test piece No. | Steel Symbol | Pre-blooming heating temperature [° C.] | Pre-wire-rolling heating temperature [° C.] | Coiling Temperature [° C.] | Average cooling rate to a temperature of 600° C. after coiling [° C./sec] | Average cooling rate at temperatures ranging from 600° C. to 300° C. [° C./sec] | Heat treatment conditions Method |
|---|---|---|---|---|---|---|---|
| 1 | A | 1,260 | 950 | 850 | 4.0 | 6.0 | FBP |
| 2 | B | 1,240 | 900 | 850 | 4.5 | 7.0 | FBP |
| 3 | C | 1,240 | 900 | 800 | 4.5 | 6.5 | FBP |
| 4 | D | 1,230 | 950 | 825 | 5.0 | 7.0 | IH |
| 5 | E | 1,240 | 1,000 | 900 | 4.5 | 7.0 | IH |
| 6 | F | 1,210 | 900 | 925 | 2.5 | 6.0 | FBP |
| 7 | G | 1,240 | 850 | 850 | 4.5 | 8.0 | FBP |
| 8 | H | 1,230 | 900 | 850 | 5.0 | 6.0 | FBP |
| 9 | I | 1,270 | 950 | 825 | 4.5 | 7.0 | IH |
| 10 | J | 1,230 | 900 | 800 | 3.0 | 9.0 | IH |
| 11 | A | 1,160 | 900 | 900 | 3.5 | 6.0 | FBP |
| 12 | A | 1,290 | 1,150 | 850 | 4.0 | 5.5 | FBP |
| 13 | B | 1,260 | 950 | 1050 | 4.5 | 6.0 | FBP |
| 14 | B | 1,260 | 900 | 925 | 0.7 | 6.0 | IH |
| 15 | B | 1,250 | 950 | 800 | 4.5 | 3.0 | IH |
| 16 | C | 1,210 | 950 | 850 | 5.0 | 6.0 | FBP |
| 17 | C | 1,220 | 900 | 850 | 5.5 | 6.5 | FBP |
| 18 | C | 1,210 | 850 | 900 | 5.0 | 7.0 | FBP |
| 19 | C | 1,230 | 850 | 850 | 4.5 | 6.5 | FBP |
| 20 | C | 1,220 | 900 | 875 | 4.5 | 6.0 | FBP |
| 21 | K | 1,230 | 900 | 875 | 5.5 | 6.5 | FBP |
| 22 | L | 1,230 | 900 | 950 | 5.0 | 6.0 | IH |
| 23 | M | 1,210 | 950 | 900 | 5.0 | 5.5 | IH |
| 24 | O | 1,210 | 900 | 900 | 4.0 | 7.0 | IH |
| 25 | P | 1,260 | 850 | 925 | 4.5 | 6.0 | IH |

TABLE 2-continued

| | | | | | | | |
|---|---|---|---|---|---|---|---|
| 26 | Q | 1,260 | 950 | 850 | 4.5 | 6.0 | IH |
| 27 | R | 1,230 | 1,000 | 875 | 5.0 | 7.0 | — |
| 28 | S | 1,230 | 950 | 850 | 5.0 | 6.0 | FBP |
| 29 | T | 1,230 | 950 | 850 | 3.5 | 6.5 | FBP |

| | Heat treatment conditions | | | | | | | |
|---|---|---|---|---|---|---|---|---|
| | | | | Quenching | | | Cr-based | |
| Test piece No. | Heating temperature [° C.] | Holding time [sec] | Average cooling rate [° C./sec] | Heating temperature [° C.] | Holding time [sec] | HV | carbide/ carbonitride Number density [particles/μm$^2$] | Inclusion breakage rate [%] |
| 1 | 920 | 192 | 3.8 | 910 | 87 | 643 | 0.03 | 0 |
| 2 | 920 | 240 | 3.0 | 920 | 96 | 629 | 0.02 | 0 |
| 3 | 910 | 192 | 3.7 | 920 | 96 | 621 | 0.02 | 0 |
| 4 | 750 | 15 | — | 940 | 80 | 609 | 0.01 | 0 |
| 5 | 730 | 15 | — | 920 | 80 | 640 | 0.02 | 0 |
| 6 | 890 | 240 | 2.8 | 930 | 87 | 642 | 0.08 | 0 |
| 7 | 920 | 240 | 4.1 | 920 | 96 | 655 | 0.03 | 0 |
| 8 | 930 | 240 | 3.1 | 930 | 87 | 647 | 0.06 | 0 |
| 9 | 760 | 10 | — | 930 | 87 | 615 | 0.04 | 0 |
| 10 | 760 | 15 | — | 940 | 96 | 645 | 0.07 | 0 |
| 11 | 910 | 192 | 3.7 | 930 | 87 | 634 | 0.28 | 30 |
| 12 | 920 | 240 | 3.0 | 950 | 87 | 635 | 0.21 | 20 |
| 13 | 920 | 160 | 4.6 | 930 | 96 | 642 | 0.31 | 30 |
| 14 | 750 | 15 | — | 950 | 87 | 632 | 0.33 | 40 |
| 15 | 730 | 10 | — | 950 | 80 | 652 | 0.41 | 30 |
| 16 | 980 | 240 | 3.6 | 940 | 80 | 620 | 0.19 | 30 |
| 17 | 920 | 320 | 2.3 | 910 | 96 | 628 | 0.48 | 60 |
| 18 | 910 | 120 | 0.8 | 930 | 96 | 652 | 0.28 | 40 |
| 19 | 920 | 160 | 4.6 | 1020 | 96 | 632 | 0.46 | 50 |
| 20 | 890 | 240 | 3.4 | 970 | 160 | 635 | 0.38 | 30 |
| 21 | 900 | 240 | 2.9 | 930 | 96 | 653 | 0.08 | 70 |
| 22 | 730 | 15 | — | 920 | 96 | 643 | 0.05 | 50 |
| 23 | 720 | 10 | — | 920 | 80 | 640 | 0.06 | 30 |
| 24 | 750 | 15 | — | 910 | 87 | 624 | 0.33 | 30 |
| 25 | 730 | 15 | — | 940 | 87 | 659 | 0.48 | 50 |
| 26 | 730 | 10 | — | 930 | 87 | 614 | 0.06 | 80 |
| 27 | — | — | — | — | — | — | — | — |
| 28 | 900 | 240 | 2.9 | 910 | 96 | 647 | 0.06 | 50 |
| 29 | 900 | 240 | 2.9 | 910 | 80 | 634 | 0.04 | 40 |

Tables 1 and 2 show the following. That is, in the test piece No. 11, the pre-blooming heating temperature was so low that the particles of the Cr-containing carbide or carbonitride were not solid-soluted sufficiently, whereby a large amount of the Cr-containing carbide or carbonitride remained, causing breakage of inclusions in the fatigue test.

In each of the test pieces No. 12 and 13, the pre-wire-rolling heating temperature and the coiling temperature were so high that the formation and growth of particles of the Cr-containing carbide or carbonitride were promoted, whereby a large amount of the Cr-containing carbide or carbonitride remained after the quenching and tempering, causing breakage of inclusions in the fatigue test.

In each of the test pieces No. 14 and 15, the average cooling rate to a temperature of 600° C. after the coiling and the average cooling rate at temperatures ranging from 600° C. to 300° C. were so slow that the formation and growth of particles of the Cr-containing carbide or carbonitride were promoted, whereby a large amount of the Cr-containing carbide or carbonitride remained after the quenching and tempering, causing breakage of inclusions in the fatigue test.

In each of the test pieces No. 16 and 19, the heating temperature in the patenting and the heating temperature in the quenching were so high that the formation and growth of particles of the Cr-containing carbide or carbonitride were promoted, whereby a large amount of the Cr-containing carbide or carbonitride remained after the quenching and tempering, causing breakage of inclusions in the fatigue test.

In each of the test pieces No. 17 and 20, the heating holding time in the patenting and the heating holding time in the quenching were so long that the formation and growth of particles of the Cr-containing carbide or carbonitride were promoted, whereby a large amount of the Cr-containing carbide or carbonitride remained after the quenching and tempering, causing breakage of inclusions in the fatigue test.

In the test piece No. 18, the average cooling rate in the patenting was so slow that the formation and growth of particles of the Cr-containing carbide or carbonitride were promoted, whereby a large amount of the Cr-containing carbide or carbonitride remained after the quenching and tempering, causing breakage of inclusions in the fatigue test.

In the test pieces No. 21, 22, and 23, the contents of C, Si, and Mn were excessive, respectively, whereby the high strength of the steel material was ensured, but the toughness and ductility thereof were degraded, causing breakage of inclusions in the fatigue test.

In the test piece No. 24, the Cr content was excessive, whereby a large amount of Cr-containing carbide or carbonitride was formed to cause breakage of inclusions in the fatigue test.

In the test piece No. 25, the V content was excessive, whereby a large amount of Cr-containing carbide or carbonitride containing V was formed to cause breakage of inclusions in the fatigue test.

In the test piece No. 26, the Al content was excessive, whereby a large amount of $Al_2O_3$ based inclusions was formed to cause breakage of inclusions in the fatigue test.

In the test piece No. 27, the B content was excessive, causing cracks in a hot-rolled material.

In the test pieces No. 28 and 29, the balance between the contents of Si and Cr was bad, and the value of Cr×Si exceeded the upper limit specified, whereby the steel material had high strength but low toughness and ductility, causing breakage of inclusions in the fatigue test.

The high-strength steel material obtained in the present invention has the excellent fatigue properties, and thus is the most suitable for use in springs, for example, in the fields of automobiles, industrial machines and the like, particularly, in a restoration mechanism for machines, such as a valve spring of the vehicle engine, a suspension spring of a suspension, a clutch spring, and a brake spring.

The invention claimed is:

1. A high-strength steel material, comprising, in percent by mass:

C: 0.5 to 1.0%;

Si: 1.5 to 2.50%;

Mn: 0.5 to 1.50%;

P: more than 0% to 0.020% or less;

S: more than 0% to 0.020% or less;

Cr: more than 0% to 0.2% or less;

Al: more than 0% to 0.010% or less;

N: more than 0% to 0.0070% or less;

O: more than 0% to 0.0040% or less; and iron and inevitable impurities, wherein:

contents of Cr and Si satisfy a formula: $Cr \times Si \leq 0.20$;

a ratio of tempered martensite in a steel microstructure of the high-strength steel material is 80% or more by area; and a number density of particles of Cr-containing carbide or carbonitride having a circle-equivalent diameter of 50 nm or more in the steel microstructure is 0.10 particles/$\mu m^2$ or less.

2. The high-strength steel material according to claim 1, further comprising, in percent by mass, one or more elements selected from the group consisting of Ni: more than 0% to 0.30% or less, V: more than 0% to 0.30% or less, and B: more than 0% to 0.0100% or less.

* * * * *